US007207202B1

(12) United States Patent
Shore

(10) Patent No.: US 7,207,202 B1
(45) Date of Patent: Apr. 24, 2007

(54) METHOD OF SUBDIVIDING AND DECELERATING HOT ROLLED LONG PRODUCTS

(75) Inventor: T. Michael Shore, Princeton, MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 11/442,929

(22) Filed: May 30, 2006

(51) Int. Cl.
*B21B 1/00* (2006.01)
*B21B 39/02* (2006.01)

(52) U.S. Cl. ..... 72/250; 72/201; 72/203; 72/228; 72/250

(58) Field of Classification Search ..... 72/201, 72/203, 250, 227, 228
See application file for complete search history.

(56) References Cited

U.S. PATENT DOCUMENTS

| | | | | |
|---|---|---|---|---|
| 3,798,950 | A | 3/1974 | Franek et al. | |
| 4,074,555 | A | 2/1978 | Noe | |
| 4,261,190 | A | 4/1981 | Fapiano | |
| 4,413,494 | A | 11/1983 | Gilvar et al. | |
| 4,478,064 | A | 10/1984 | Brenneman | |
| 4,884,429 | A | 12/1989 | Wilson | |
| 5,423,200 | A * | 6/1995 | Shore | 72/201 |
| 6,128,937 | A | 10/2000 | Seidel | |
| 6,745,607 | B2 | 6/2004 | Kato et al. | |
| 6,920,772 | B1 | 7/2005 | Shore et al. | |
| 7,069,759 | B2 * | 7/2006 | Shore et al. | 72/203 |

FOREIGN PATENT DOCUMENTS

GB 2118875 A * 11/1983

* cited by examiner

*Primary Examiner*—Dmitry Suhol
(74) *Attorney, Agent, or Firm*—Gauthier & Connors, LLP

(57) ABSTRACT

A method is disclosed for subdividing and decelerating a hot rolled long product advancing along a delivery path from a rolling mill to a cooling bed. The method comprises:

(a) arranging a shear and a decelerator in succession along the delivery path, with the decelerator comprising a set of driven pinch rolls preceded by a plurality of deflector rolls;

(b) contacting a lead segment of the product with the pinch rolls operating at an initial speed at least equal to that of the advancing product;

(c) actuating the shear to separate the lead segment from the remainder of the product; and (d) decelerating the lead segment by:

(i) reducing the speed of the pinch rolls; and (ii) actuating the deflector rolls to deflect the product segment from the delivery path into a sinuous path.

5 Claims, 1 Drawing Sheet

METHOD OF SUBDIVIDING AND DECELERATING HOT ROLLED LONG PRODUCTS

BACKGROUND OF THE INVENTION

1. Field of the Invention

This invention relates generally to rolling mills delivering hot rolled long products to cooling beds, and is concerned in particular with a method of subdividing and decelerating such products prior to their arrival at the cooling bed. As herein employed, the term "long products" refers to bars and rods, and the like.

2. Description of the Prior Art

As disclosed for example in U.S. Pat. No. 4,413,494, it is known to use driven pinch rolls to grip and decelerate hot rolled long products. When used alone, however, the heavy pressure exerted by the pinch rolls can deform or otherwise mar the product surfaces. This is of particular concern with products that have ribbed surfaces, e.g., concrete reinforcing bars.

The use of staggered rolls to effect deceleration by deflecting long products into elongated sinuous paths is also known, as shown for example in U.S. Pat. No. 4,884,429. However, when used alone, such staggered roll arrangements are incapable of adequately decelerating products at the higher delivery speeds of modern rolling mills. Moreover, the use of staggered roll arrangements to decelerate product leading ends is likely to produce cobbles.

SUMMARY OF THE INVENTION

The present invention stems from the discovery that although the use of either pinch rolls or staggered rolls, by themselves, can lead to problems, their application in concert to the products can provide highly effective deceleration without deforming the products or marring their surfaces.

A more detailed description of the invention and its attendant advantages will now be provided with reference to the accompanying drawings, wherein:

DETAILED DESCRIPTION OF THE INVENTION

Figure 1:
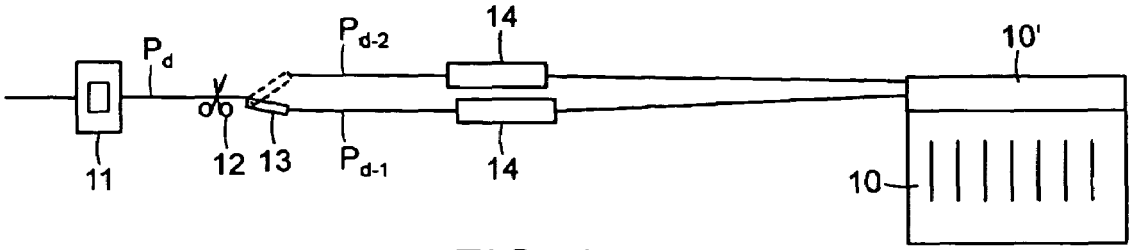
FIG. 1 is a schematic plan view of a rolling mill installation incorporating a system in accordance with the present invention.

With reference initially to FIG. 1, an exemplary mill layout is shown comprising a cooling bed 10 arranged to receive long products being delivered along path $P_d$ from the last roll stand 11. A shear 12 serves to subdivide the products, and a switch 13 directs the severed product segments alternatively to paths $P_{d\text{-}1}$ and $P_{d\text{-}2}$ leading to the cooling bed's run on table 10'. From here, the products are shifted laterally across the cooling bed to receiving equipment (not shown) for further processing, e.g., cutting to customer lengths, bundling, etc.

Figure 2A:
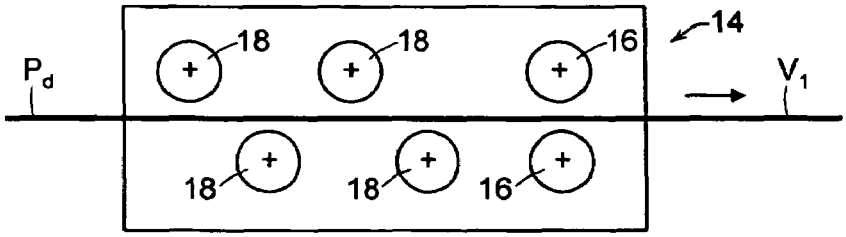
FIGS. 2A–2C are schematic illustrations respectively depicting the decelerator in different operational stages.
Figure 2B:
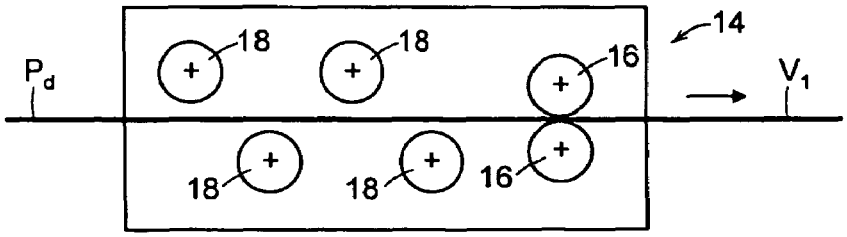
Figure 2C:
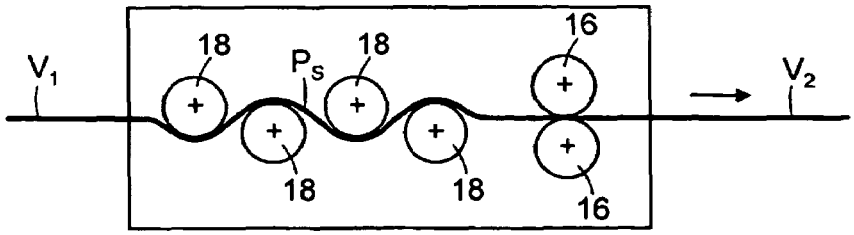

Decelerators 14 in accordance with the present invention are positioned along paths $P_{d\text{-}1}$ and $P_{d\text{-}2}$ between the switch 13 and the cooling bed 10. As can be best seen by further reference to FIGS. 2A–2C, each decelerator 14 includes a set of driven pinch rolls 16 preceded by a plurality of deflector rolls 18 staggered on opposite sides of the delivery path P. The deflector rolls 18 are preferably freewheeling, and are adjustable between inoperative positions removed from the delivery path, as shown in FIGS. 2A and 2B, and operative positions projecting into the delivery path, as shown in FIG. 2C. Adjustment of the deflector rolls 18 between their operative and inoperative positions may be effected by any known mechanism, a non-limiting example being that disclosed in U.S. Pat. No. 4,884,429, the description of which is herein incorporate by reference.

The pinch rolls 16 are adjustable between open positions as shown in FIG. 2A, and closed positions as shown in FIG. 2B. The pinch rolls may be driven and adjusted between their open and closed positions by mechanisms known to those skilled in the art, one non-limiting example being that disclosed in U.S. Pat. No. 6,920,772, the description of which is also herein incorporated by reference.

In an exemplary operation, a hot rolled long product will exit the last roll stand 12 at a velocity $V_1$ of between about 14 to 40 m/sec., depending on the size of the product being rolled. With the decelerators in the condition shown in FIG. 2A, a leading segment of the product will pass freely through the shear 12 and will be directed by the switch 13 to path $P_{d\text{-}1}$.

As shown in FIG. 2B, the leading segment is then contacted by the driven pinch rolls 16, with the pinch rolls operating at an initial speed at least equal to and preferable slightly faster than the exiting velocity $V_1$ of the product. As herein employed, "speed" means the rotational velocity of the pinch roll surfaces in contact with the product.

The leading product segment is then severed from the remainder of the product by actuation of the shear 13, and the trailing segment of the product is directed by switch 13 to path $P_{d\text{-}2}$. With the severed leading segment of the product now separated from the remainder of the product still being propelled by the mill roll stands, and as shown in FIG. 2C, the pinch rolls 16 are decelerated to a speed $V_2$ less than $V_1$, and the deflector rolls 18 are moved into the path $P_d$ to deflect the product into a sinuous path $P_s$. The increased length of the sinuous path $P_s$ acts in concert with the reduced speed of the pinch rolls to effect deceleration of the product to the slower velocity $V_2$. By virtue of this concerted action, which preferably occurs simultaneously, the force with which the product is gripped between the pinch rolls can be beneficially reduced, thus avoiding product deformation and also avoiding or at least beneficially lessening any degree of marking the surface of the product. The trailing product segment traveling along path Pd-2 is similarly acted upon and slowed by the other decelerator.

What is claimed is:

1. A method of subdividing and decelerating a hot rolled long product advancing along a delivery path from a rolling mill to a cooling bed, said method comprising the steps of:

(a) arranging a shear and a decelerator in succession along said delivery path, said decelerator comprising a set of driven pinch rolls preceded by a plurality of deflector rolls;

(b) contacting a lead segment of said product with said pinch rolls operating at an initial speed at least equal to that of the advancing product;

(c) actuating said shear to separate said lead segment from the remainder of said product; and (d) decelerating said lead segment by:

(i) reducing the speed of said pinch rolls; and (ii) actuating said deflector rolls to deflect said product segment from said delivery path into a sinuous path.

2. The method of claim 1 wherein steps (b), (c), and (d) are performed sequentially.

3. The method of claim 2 wherein steps (d)(i) and (d)(ii) are performed simultaneously.

4. The method of claims 1, 2, or 3 wherein said initial speed is higher than that of the advancing product.

5. The method of claim 1 wherein said deflector rolls are freewheeling and staggered on opposite sides of said delivery path.

* * * * *